United States Patent [19]

Stoody

[11] 4,189,069

[45] Feb. 19, 1980

[54] SQUEEZE TUBE SACK FOR AEROSOL TYPE CONTAINERS

[76] Inventor: William R. Stoody, 5008 County Line, New Haven, Mich. 48048

[21] Appl. No.: 887,580

[22] Filed: Mar. 17, 1978

[51] Int. Cl.[2] ..... B65D 35/22

[52] U.S. Cl. ..... 222/83.5; 222/94; 222/105; 222/402.16

[58] Field of Search ..... 222/83.5, 86, 88, 94, 222/95, 105, 107, 183, 386.5, 387, 389, 402.16, 402.21, 402.22, 402.23; 239/323

[56] References Cited

U.S. PATENT DOCUMENTS

| | | | |
|---|---|---|---|
| 2,594,161 | 4/1952 | Harrison | 222/83.5 |
| 2,816,691 | 12/1957 | Ward | 222/402.1 X |
| 3,169,670 | 2/1965 | Hrebenak et al. | 222/387 X |
| 3,421,698 | 1/1969 | Baltzer | 222/386.5 X |
| 3,731,854 | 5/1973 | Casey | 222/402.1 X |
| 4,121,737 | 10/1978 | Kain | 222/95 |

*Primary Examiner*—Allen N. Knowles
*Assistant Examiner*—Fred A. Silverberg
*Attorney, Agent, or Firm*—Cullen, Sloman, Cantor, Grauer, Scott, & Rutherford

[57] ABSTRACT

In an aerosol type container having a pressure chamber and a cover adapted to receive and mount a valve assembly, an elongated flexible squeeze tube of impervious material is nested within the chamber and contains material to be dispensed through the valve assembly. A tube retainer centrally mounts and suspends the tube. A support is formed upon the interior of the container adjacent its cover supportably and retainingly engaging the tube retainer.

8 Claims, 4 Drawing Figures

SQUEEZE TUBE SACK FOR AEROSOL TYPE CONTAINERS

BACKGROUND OF THE INVENTION

Environmental problems of fluorocarbons and hydrocarbons have created the need for an environmentally acceptable means of dispensing aerosol products. Other propellants are available but often they are not compatible with the product. Thus, a means of separating the product from the propellant is needed and can be accomplished by the utilization of an internal product containment sack. The use of such a sack also makes it possible to use air pressure as the propelling means.

If air pressure is used, refrigerating equipment that would otherwise be required to keep the propellant in a liquid form is not necessary. This further reduces chances of fluorocarbon escaping into the atmosphere due to leaks in the equipment.

The present invention represents a modification of the pressurized dispenser in Applicant's copending patent application, Ser. No. 781,784 filed Mar. 28, 1977, now abandoned and also an additional application filed Dec. 14, 1977, Ser. No. 860,354, U.S. Pat. No. 4,159,789 dated July 3, 1979.

Cost of new tooling and changes in packaging methods are not readily accepted by the manufacturers of aerosol products. These costs along with cost of the product and containers must be passed to the consumer. Should the resultant cost be excessive, the product cannot be competitive with other non-aerosol alternatives. The present improved invention is devised to keep the aerosols competitive and environmentally acceptable. Other dispensers in the art having a collapsible sack are shown in the following U.S. Patents: Nos.

| | |
|---|---|
| 3,549,058 | Inventor: E. J. Bolk |
| 3,477,195 | Inventor: C. D. Chambers |
| 2,816,691 | Inventor: L. T. Ward |
| 3,731,854 | Inventor: D. E. Casey |
| 3,169,670 | Inventors: P. Hrebenak & L. Zuckerman |

Also, a self-heating shave cream manufactured by the Gillette Company utilizes a sack contained inside the dispenser.

The Bolk and Chambers Patents employ a bellows shape and have similar disadvantages that were described in the Casey Patent. Another disadvantage is the nature of their construction. They prevent efficient utilization of the pressurizing agent since the pressure applied to the sack is effective from the bottom surface area. This means the dispensing force is equal to (PSI TT $D^2$, whereas, a sack of tubular shape has the effective pressure force over its entire surface (length X the TT $R^2$ X PSI). The bellows-shaped sacks also require special manufacturing processes and cannot be readily adapted to providing a use of the propellant for nozzle clearing. The Bolk Patent further limits the method in which the propellant can be introduced within the pressure chamber. It requires a plugged hole in the container since the sack, when installed, closes off the top opening in the container cover.

The Casey Patent illustrates a sack that has longitudinal pleats. The shape while better utilizing the pressure is subject to undesired buckling of the walls that could prevent total dispensing of a product. Additionally, the sack is sealingly attached to the valve assembly which means filling must be accomplished through the valve. This causes slower and more costly filling. It also prevents the use of the propellant for nozzle clearing. It, too, requires a plugged hole in the container for pressurizing.

The Ward and Hrebenak/Zuckerman Patents describe a flexible balloon-shaped sack. This sack can prove to be the most unreliable because of its uncontrolled collapsing nature. Since the pressure in the container is always pushing toward the valve when dispensing, it can push a portion of the sack over the valve opening, thus, blocking off the product. It is also designed to be attached in such a manner that limits its use since, it will not allow use of the propellant for nozzle clearing. Also unless it is pre-filled and secured to the valve prior to insertion within the container, the sack is subjected to being inadvertently pushed inside the container rendering it useless.

The Gillette dispenser appears to be similar to the Ward invention, although it employs a semi-rigid sack somewhat resembling a test tube. Although it is in the market place, its packaging requirements have proven to be too costly for most products. The filling of both the product and pressurizing agent requires extensive assembly while in a refrigerated environment. Although this may not be so uncommon the Gillette method also requires that the sack be filled with the product and heat-sealed to the valve while in such an environment prior to being placed within a container already having the required amount of propellant. The sack design is also quite stiff at the top and bottom, thus, restricting it from efficiently collapsing. It does not appear to be adaptable to liquid spray-type products.

The above application Ser. No. 781,784 illustrates a sack having an improved shape that efficiently utilizes the pressure but does not provide an economical method of assembly. It also requires pressurizing through a plugged hole.

The second application Ser. No. 860,354 now U.S. Pat. No. 4,159,789, provides a sack having further improved collapsing features. The primary disadvantage of this unit is that it is not readily adapted to existing valves and containers. This causes a resistance by the industry due to change over and tooling cost. It also is mainly designed to utilize a plurality of sacks. This is yet to be tried by the industry.

SUMMARY OF THE INVENTION

Quite clearly, an acceptable alternate is still needed and the primary object of this invention is to satisfy that need.

It is another object to provide an aerosol that can be propelled by air pressure as well as liquid propellants.

It is another object to provide an improved impervous squeeze tube, for fluid-like materials to be dispensed, that can be easily and economically manufactured in a variety of sizes and utilize existing high volume construction techniques.

It is another object to provide an improved economically feasible tube retaining means for said squeeze tube.

It is another object to economically attach said tube within dispensing containers are presently constructed without modification.

It is another object to provide a squeeze tube that can be readily filled with any desired product either liquid or fluid-like or such viscuous materials as toothpaste and also dispensing in a desired form.

It is another object that said tube permits securing the valve assembly in a conventional manner.

It is another object to provide a means of pressurizing without requiring a special opening in the container.

It is another object to provide a means of filling and pressurizing at room temperature and does not require refrigeration.

It is another object to provide a means of affixing said tube securely in a predetermined location.

These and other objects will be seen from the following specification and claims in conjunction with the appended drawing.

THE DRAWING

Figure 1:
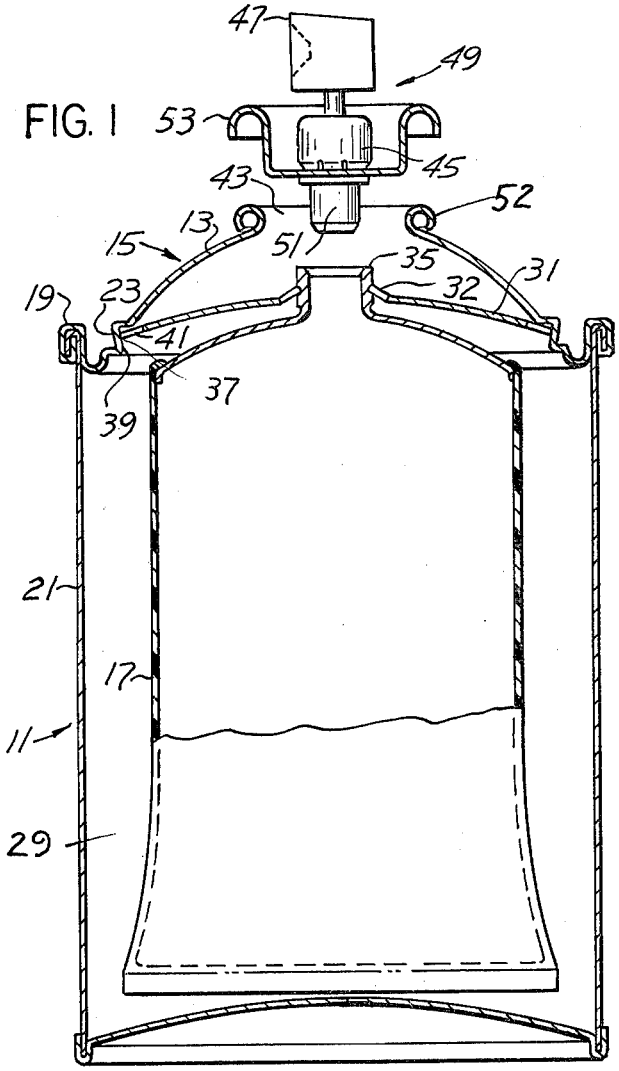
FIG. 1 is a partly exploded longitudinal section of an aerosoltype container with the dispensing squeeze tube supportably retained therein.

It will be understood that the above drawing illustrates merely a preferred embodiment of the invention, for illustration, and that other embodiments are contemplated within the scope of the Claims hereafter set forth.

DETAILED DESCRIPTION OF THE INVENTION

The construction of aerosol-type containers 11 as presently manufactured provide a feature within the crown 13 of the cover 15 that enables retainment of the tube 17. The purpose of said feature is to facilitate the securing of the cover as at 19 to the side walls 21 of the container. Said feature is an obscure inwardly and downwardly sloped ridge 23 formed around the base of the cover crown 13. Deep drawn containers not having a separate cover can easily be modified to provide an equivalent retaining feature around the wall near the top for the purpose of retaining the tube, as in FIG. 4.

Figure 2:
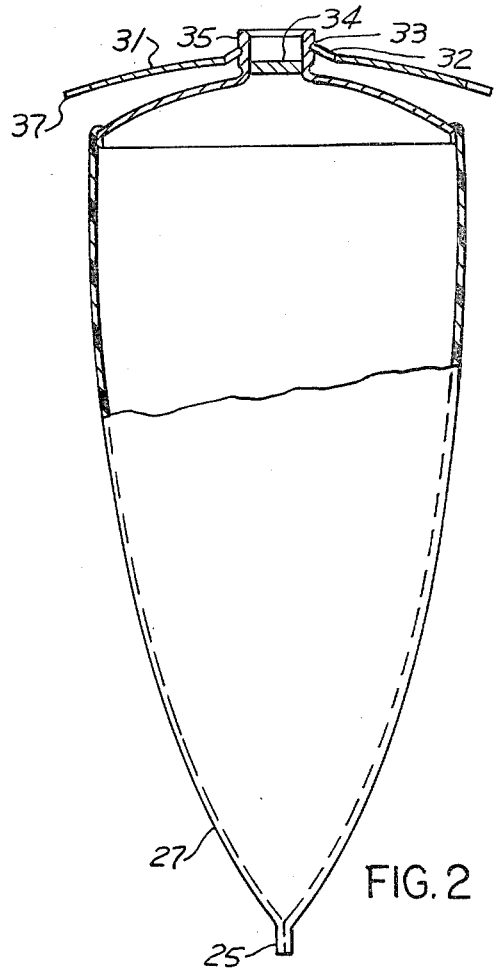
FIG. 2 is a side view on a slightly increased scale of the tube and tube retainer shown in FIG. 1.

The squeeze tube or sack 17 is of a conventional plastic or thin metal product dispensing tube construction. This shape is desired for the best dispensing results, since the pressure is mainly effective on the side surfaces of the tube. It is also desired because of its proven economical construction. The side wall also provides strength in a longitudinal direction preventing undesired collapsing that could otherwise prevent proper dispensing. During the final stages of dispensing the last of the product the wall will finally collapse up into the top of the tube, thus, forcing out any product that would otherwise remain therein. The sealing seam 25, formed at the bottom of the tube creates a crosswise stiffener that causes the tube walls to collapse in a predictable manner. It also creates a downwardly tapered shape 27, FIG. 2, in the tube that helps to add strength to the tube walls. The additional width at the bottom of the tube is created when forming the seam 25 by a heat sealing process does not effect the size of the container since space 29 must be provided around the tube for the pressurizing agent either air or other suitable propellant. The primary modification to the tube is the adoption of a retainer 31.

Figure 3:
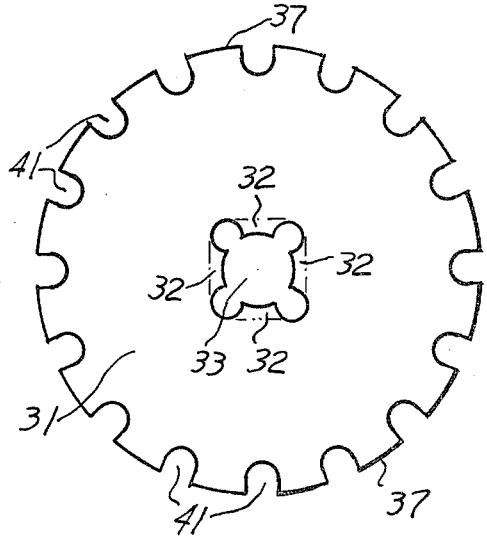
FIG. 3 is a top plan view thereof.

The tube retainer has a central opening 33 which fits to the tube neck 35 and is of basically a disc shape, FIG. 3, having an outer diameter edge 37 that is slightly greater than the smallest diameter 39 of the inwardly sloped ridge 23 formed in the container cover crown 13. This allows the tube retainer to be securely snapped intp place, FIG. 1, within the cover 15. It also places and firmly captivates the tube 17 in a predetermined position. This can be done prior to affixing the cover to the container body 21 by the container manufacturer or product packager. In such cases as where the container is formed with an integral cover, it can easily be installed prior to attaching the container bottom.

The tube or sack retainer 31 is made of an impervious material and is approximately 0.015 thick and upwardly concaved giving it rigidity and strength. It is provided with a toothed outer diameter 37. The notches 41 permit pressurizing air or other propellants to be introduced within the container through the top valve opening 43 in the container cover 13. They also provide an access to the valve housing 45 should it be required to utilize the pressurizing agent for clearing of valve nozzle. The toothed outer diameter 37 yields upon entry within the cover ridge 23 and diverts otherwise dislodging forces into increased retention strength.

Retention of tube 17, FIG. 1, is accomplished by having an internal toothed opening 33 concentrically located in said retainer 31. Each tooth 32 being bent slightly to yieldingly permit entry of sack neck 35. The said internally tooth opening like said toothed outer diameter 41 diverts dislodging forces into retention strength.

Said retainer 31 can alternatively be affixed to the sack neck 35 in a variety of ways such as heat bonding, being integrally formed with the sack neck or by use of screw threads.

Although a retainer shape has been described, other shapes such as hexagon or square with rounded corners along with two piece retainers that interlockingly engage said sack neck and side walls of said container are considered equivalent. Likewise, the material and thickness can vary to correspond with the fabrication techniques employed.

When in place within the container, said retainer is inwardly cup-shaped toward the cover crown 13. This provides added holding strength against inward pressures and prevents it from being pushed loose in the event the valve assembly 49 is ultimately sealingly pressed into the sack neck as at shank 51. It is also recognized that the retainer 31 can be purposely formed to allow the sack or tube to be spaced lower in the crown 13 should the crown depth be rather shallow as might be found in some standard container covers and additional space might be required for the valve assembly 49.

Filling of the sack by the product packager is easily accomplished through the sack neck 35 by several conventional methods. One such being a tubular device loosely inserted into the sack neck. This allows the desired product to enter through the tube while the atmospheric air escapes from within the sack out around the exterior of the filling tube without blocking entry of the product.

Alternatively, the sack can be pre-filled by a conventional tube filling and sealing process prior to being retainingly fitted in place. In such case, the sack neck opening is closed by either a thin membrane that is pierced upon the eventual entry of valve shank 51 or a plug 34 that is ultimately pushed into the sack during entry of the valve shank 51.

Propellant or pressurizing air can be conventionally introduced through the valve opening 43 in the top of the container prior to sealingly securing the valve assembly and valve retainer 53 in place at beaded valve opening 52.

Sealing off the product containment sack 17 from the pressurizing chamber 29 is accomplished by the valve housing 45. It can be such that its shank 51 will sealingly fit within the sack neck either by press fit, twisting or application of a sealant.

The sack neck 35 can be of appropriate size and shape for filling and acceptance of the valve and also the sack retainer 31. It is desired that the retainer fit to the neck rather than the outer diameter of the shoulder portion of the sack top closure where it is heat sealed to the sack walls. Although not absolute, it does allow easier collapsing of the sack.

Likewise, it is desirable to keep the sack neck as small as practical. The size should be only as large as required for filling of the desired product in an economical manner or as required by the valve shank 51, whichever is greater.

MODIFICATION

Figure 4:
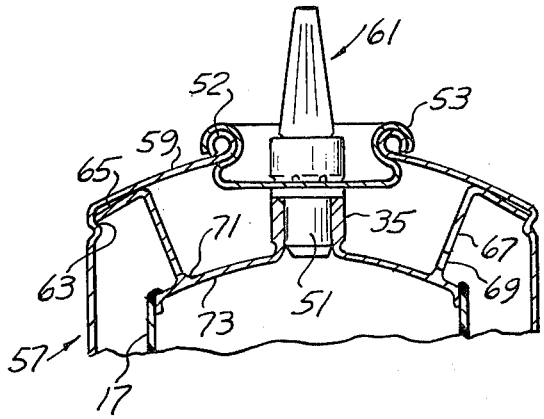
FIG. 4 is a fragmentary longitudinal section of a modified aerosol container with a modified tube retainer supported therein.

A modified circular sack or tube retainer 65 is snapped over internal bead 63 adjacent cover 59 of aerosol container 57, FIG. 4. The beaded valve opening 52 of said cover has secured thereto the conventional tilt valve assembly 61.

Said sack retainer has an inwardly tapered annular shank 67 apertured at 69 and at its lower end, secured at 71 to sack cover 73.

Said sack retainer 65 and shank 67 may be molded or formed as a part of sack cover 73. As in FIG. 1, sack retainer 65 is flexibly snapped over container bead 63.

Having described my invention, reference should now be had to the following claims.

I claim:

1. In an aerosol-type container including a first pressure chamber and a cover, said cover having an opening for receiving propellant gas and having a valve assembly mounted thereon;

an elongated flexible and collapsible sack of impervious material nested within said chamber and containing material of predetermined form for dispensing through said valve assembly;

an upwardly concave sack retainer disc centrally mounting and suspending said sack;

and a single annular projection formed on the interior of the cover supportably and retainingly engaging said sack retainer disc by a snap fit;

said disc being apertured and spaced from said cover opening defining a second chamber above said disc communicating with said pressure chamber, said pressure chamber being pressurized with the propellant passing through the cover opening and through said second chamber immediately prior to the mounting of the valve assembly within said cover opening.

2. In the container of claim 1, said sack having an apertured neck at one end;

said sack retainer disc retainingly engaging said neck.

3. In the container of claim 1, said sack retainer disc being formed as a part of said sack.

4. In the container of claim 1, said projection including an inherent annular projection formed within said cover, whereby the peripheral edge portions of said retainer disc are interlockingly engaged therewith.

5. In the container of claim 1, said annular projection having an opening of a dimension less than the maximum dimension of said sack retainer disc.

6. In the container of claim 1, said sack being of a squeeze tube shape and construction, including a top closure with a neck projecting therefrom and depending side wall portions converging towards their lower ends and terminating in a transverse bottom seam.

7. In the container of claim 2, said apertured sack neck having a sealing plug that permits said sack to be pre-filled by use of conventional squeeze tube filling and sealing technology;

said plug temporarily sealing said apertured sack neck prior to eventual penetrating and sealing entry of a portion of said valve assembly.

8. In the container of claim 1, said retainer disc being a device which interlockingly engages said sack and retains said sack in a predetermined location.

* * * * *